US009918547B2

(12) United States Patent
Wilmes et al.

(10) Patent No.: US 9,918,547 B2
(45) Date of Patent: Mar. 20, 2018

(54) REFRIGERATED FOOD PREPARATION TABLE AND HINGE BRACKET FOR HOLDING LID PARTIALLY OR FULLY OPEN

(71) Applicant: True Manufacturing Co., Inc., O'Fallon, MO (US)

(72) Inventors: Daniel A. Wilmes, Wentzville, MO (US); Steven Lee Trulaske, Sr., St. Louis, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 0 days.

(21) Appl. No.: 15/063,557

(22) Filed: Mar. 8, 2016

(65) Prior Publication Data

US 2017/0258219 A1 Sep. 14, 2017

(51) Int. Cl.
*A47B 31/00* (2006.01)
*A47B 31/02* (2006.01)
(Continued)

(52) U.S. Cl.
CPC ..... *A47B 31/02* (2013.01); *B65D 43/167* (2013.01); *E05D 3/18* (2013.01); *E05D 7/105* (2013.01);
(Continued)

(58) Field of Classification Search
CPC ..... Y10T 16/544; Y10T 16/5443; Y10T 16/5448; E05D 3/12; F25D 2400/10; F25D 2400/08; E05Y 2900/20; A47F 10/06
(Continued)

(56) References Cited

U.S. PATENT DOCUMENTS 457,556 A 8/1891 Pike, Jr.
721,204 A 2/1903 Landt
(Continued)

FOREIGN PATENT DOCUMENTS

FR 2662464 11/1991
KR 1019990049517 7/1999
KR 100875879 12/2008

OTHER PUBLICATIONS

True Manufacturing Co., Inc., True TPP-44D-2 44 Two Drawer Refrigerated Pizza Prep Table, retrieved from www.webstaurantstore.com/true-tpp-44d-2-44-two-drawer-refrigerated-pizza-prep-table/890TPP44D2.html on Mar. 8, 2016.
(Continued)

*Primary Examiner* — Janet M Wilkens
(74) *Attorney, Agent, or Firm* — Bryan Cave LLP

(57) ABSTRACT

A refrigerated food preparation table that includes a food item storage pan with a lid that is allowed to fully close and is held in a partially open position and in a fully open position and hinge brackets or apparatuses for holding a lid in a partially opened position and a fully opened position that include a slot, a surface, and an indentation that each engage pins on the lid. In various embodiments, the slot receives one such pin, the surface guides another pin on the lid as the lid is opened from a fully closed position to the partially opened position, the indentation receives the second pin when the lid is in the partially opened position, and the slot contains the first pin and the second pin when the lid is fully open. The food preparation table can be used to prepare pizza, for example.

19 Claims, 2 Drawing Sheets

(51) Int. Cl.

| | |
|---|---|
| ***B65D 43/16*** | (2006.01) |
| ***E05D 11/10*** | (2006.01) |
| ***E05D 7/10*** | (2006.01) |
| ***E05D 3/18*** | (2006.01) |

(52) U.S. Cl.
CPC .... *E05D 11/1028* (2013.01); *A47B 2031/003* (2013.01); *E05D 2007/1094* (2013.01)

(58) Field of Classification Search
USPC ..... 49/260, 261; 108/25, 26; 312/114, 312/138.1, 139, 326–329, 229, 405, 236
See application file for complete search history.

(56) References Cited

U.S. PATENT DOCUMENTS

| | | | | | |
|---|---|---|---|---|---|
| 1,144,262 | A | | 6/1915 | Tatum | |
| 1,185,233 | A | | 5/1916 | Minnis | |
| 2,381,667 | A | * | 8/1945 | Jensen | F25C 1/24 294/161 |
| 2,435,670 | A | * | 2/1948 | Buehler | A01C 15/00 16/358 |
| 3,396,928 | A | * | 8/1968 | Lay | A47B 3/0815 108/129 |
| 4,250,959 | A | * | 2/1981 | Spasojevic | A47J 27/04 126/379.1 |
| RE30,890 | E | * | 3/1982 | Hodge | B65F 1/1623 16/361 |
| 4,362,118 | A | | 12/1982 | Koch, Jr. et al. | |
| 4,485,524 | A | * | 12/1984 | Neville | E05D 7/081 16/241 |
| 4,649,599 | A | * | 3/1987 | Beller | A47J 36/12 16/319 |
| 5,054,723 | A | | 10/1991 | Arnold | |
| 5,117,649 | A | * | 6/1992 | Mangini | A47F 3/0439 62/251 |
| 5,168,719 | A | | 12/1992 | Branz et al. | |
| 5,182,924 | A | | 2/1993 | Trulaske, Sr. | |
| 5,210,888 | A | * | 5/1993 | Canfield | A47C 29/003 16/358 |
| 7,219,608 | B2 | * | 5/2007 | Sung | A47B 37/00 108/50.11 |
| 7,243,406 | B1 | | 7/2007 | Wray | |
| 7,383,835 | B2 | * | 6/2008 | Liu | A47J 37/0704 126/194 |
| 8,281,459 | B2 | | 10/2012 | Le et al. | |
| 2011/0304983 | A1 | * | 12/2011 | Senatori | G06F 1/1616 361/679.55 |
| 2011/0316310 | A1 | | 12/2011 | Runde | |
| 2015/0173526 | A1 | * | 6/2015 | Delgadillo | F25D 11/00 62/99 |

OTHER PUBLICATIONS

True Manufacturing Co., Inc., Food Prep Table: Drawered Pizza Prep Table specification sheet, Jul. 2015, 2 pages.

Patent Cooperation Treaty, International Search Report issued for PCT/US2017/021243, dated May 30, 2017, 3 pages May 30, 2017.

* cited by examiner

REFRIGERATED FOOD PREPARATION TABLE AND HINGE BRACKET FOR HOLDING LID PARTIALLY OR FULLY OPEN

RELATED PATENT APPLICATIONS

This patent application does not claim priority to any other patent application.

FIELD OF THE INVENTION

Various embodiments of this invention relate to refrigerated food preparation tables that have a food item storage pan having a hinged lid thereon and to apparatuses for holding a lid in a partially open position and in a fully open position.

BACKGROUND OF THE INVENTION

Refrigerated food preparation tables have been used to store food items and prepare food products, for example, for service to customers. The refrigeration has preserved the food items until use and storage pans have been used to store multiple food items for ready access for production of the food products. Pivoted covers have been used to cover the food items. U.S. Pat. No. 5,182,924 concerns an example of a refrigerator unit for food products, for example, for storing and serving salads and sandwiches. In the prior art, refrigerated food preparation table covers were movable from a closed position to an open position that afforded at least some access to the food items, but various needs, potential areas for benefit, or opportunities for improvement exist for refrigerated food preparation tables that provide better access or improved protection of the food items, for example, during food product preparation, when restocking the food items, or both.

Further, apparatuses have previously been contemplated that detent a hinged lid in fully open, partially open, and closed positions. U.S. Pat. No. 4,362,118 concerns an example of a hatch cover for barges with a hinge detenting mechanism that uses various pins and a spring. Various needs, potential areas for benefit, or opportunities for improvement exist, however, for improved or alternative apparatuses for holding a lid in partially open and fully open positions. Room for improvement exists over the prior art in various areas that may be apparent to a person of ordinary skill in the art having studied this document.

SUMMARY OF PARTICULAR EMBODIMENTS OF THE INVENTION

This invention provides, among other things, various appliances, such as (e.g., refrigerated) food preparation tables that include a food item storage pan that has a lid. Further, in a number of embodiments, the lid is allowed to fully close over the food item storage pan and the lid is held in a partially open position and in a fully open position (e.g., connected with multiple hinges). Further, this invention also provides, among other things, various apparatuses for holding a lid in a partially opened position and a fully opened position. In a number of embodiments, such an apparatus includes a slot, a surface, an indentation, or a combination thereof, for instance, that act on or engage pins on the lid. In various embodiments, the slot receives one such pin, the surface guides another pin on the lid, for example, as the lid is opened from a fully closed position to the partially opened position, the indentation receives the second pin when the lid is in the partially opened position, the slot contains the first pin and the second pin when the lid is in the fully opened position, or a combination thereof.

Various embodiments provide, for example, as an object or benefit, that they partially or fully address or satisfy one or more of the needs, potential areas for benefit, or opportunities for improvement described herein, or known in the art, as examples. For instance, certain embodiments provide various (e.g., refrigerated) food preparation tables that provide better access or improved protection of the food items, for example, during food preparation, when restocking the food items, or both. Further, particular embodiments provide various improved or alternative apparatuses for holding a lid in partially open and fully open positions.

Specific embodiments of the invention include, for example, various (e.g., refrigerated) food preparation tables that include a food item storage pan that includes a lid and multiple hinges connecting the lid to the remainder of the refrigerated food preparation table. In various embodiments, the multiple hinges allow the lid to fully close over the food item storage pan, the hinges hold the lid in a partially open position, and the hinges hold the lid in a fully open position. Further, in some such embodiments, the lid includes a first pin and a second pin, and the multiple hinges include a slot, a first surface, an indentation, or a combination thereof, for instance, that act on or engage the first pin and the second pin. For example, in some embodiments, the slot receives the first pin, the first surface guides the second pin as the lid is opened from the fully closed position to the partially opened position, or both. Further, in some embodiments, the indentation receives the second pin when the lid is in the partially opened position. Still further, in some embodiments, the slot contains the first pin and the second pin when the lid is in the fully opened position. Even further, in particular embodiments, the first pin is parallel to the second pin.

A number of embodiments include a first (e.g., flat) plate, for example, that includes the slot, the first surface, the indentation, or a combination thereof. Further, various embodiments include a second (e.g., flat) plate, for instance, perpendicular to the first (e.g., flat) plate. In some embodiments, the second plate is connected to the first plate. In some embodiments, for example, the second (e.g., flat) plate attaches (e.g., one of the multiple hinges) to the remainder of the refrigerated food preparation table. Still further, a number of embodiments include a second surface (e.g., on the first plate). For instance, in some embodiments, the second surface guides the second pin, for example, as the lid is opened from the partially open position to the fully opened position. Even further, in some embodiments, the second surface is between the indentation and the slot. Further still, in various embodiments, the slot includes a top portion and a bottom portion. Even further still, in some such embodiments, the top portion slopes in a substantially opposite direction from the bottom portion. Moreover, in certain embodiments, the top portion is at a (e.g., substantially) right angle to the bottom portion. In some embodiments, for example, the (e.g., substantially) right angle is substantially midway between a top and a bottom of the slot. Furthermore, in some embodiments, the indentation includes a first convex surface, a second convex surface, a concave surface, or a combination thereof. For example, in particular embodiments, the concave surface is between the first convex surface and the second convex surface.

Other specific embodiments include various apparatuses for holding a lid in a partially opened position and a fully opened position. In some embodiments, for example, the apparatus includes, for example, a slot, a first surface, an indentation, or a combination thereof, for instance, that engage various pins on the lid. In some embodiments, for example, the slot receives a first pin on the lid, the first surface guides a second pin on the lid as the lid is opened from a fully closed position to the partially opened position, the indentation receives the second pin when the lid is in the partially opened position, or a combination thereof. Further, in a number of embodiments, the slot contains the first pin and the second pin when the lid is in the fully opened position.

Various such embodiments include other features described above and vice versa. For example, in some embodiments, the apparatus includes a first (e.g., flat) plate that includes the slot, the first surface, and the indentation. Further, some embodiments, include a second (e.g., flat) plate, for example, perpendicular to, connected to, or both, the first (e.g., flat) plate. Moreover, in some embodiments, the second (e.g., flat) plate is for, or includes multiple holes for, attaching the apparatus to a mounting surface that supports the lid. Still further, in some embodiments, a second surface (e.g., on the first plate) guides the second pin on the lid, for example, as the lid is opened from the partially open position to the fully opened position, and in particular embodiments, the first surface is curved, the second surface is curved, the second surface is between the indentation and the slot, or a combination thereof.

In various embodiments, the slot includes a top, a bottom, and a (e.g., right or substantially right) angle. Further, in a number of such embodiments, the (e.g., right or substantially right) angle is (e.g., substantially midway or midway) between the top and the bottom. Still further, in some embodiments, the slot includes a top portion and a bottom portion. In some such embodiments, for example, the top portion slopes in a substantially opposite direction from the bottom portion. Even further, in some embodiments, the top portion is at a (e.g., right or substantially right) angle to the bottom portion. Even further, in some embodiments, the indentation includes a first convex surface, a second convex surface, and a concave surface, for example, between the first convex surface and the second convex surface. In addition, various other embodiments of the invention are also described herein, and various benefits of certain embodiments may be apparent to a person of ordinary skill in the art.

Figure 1:
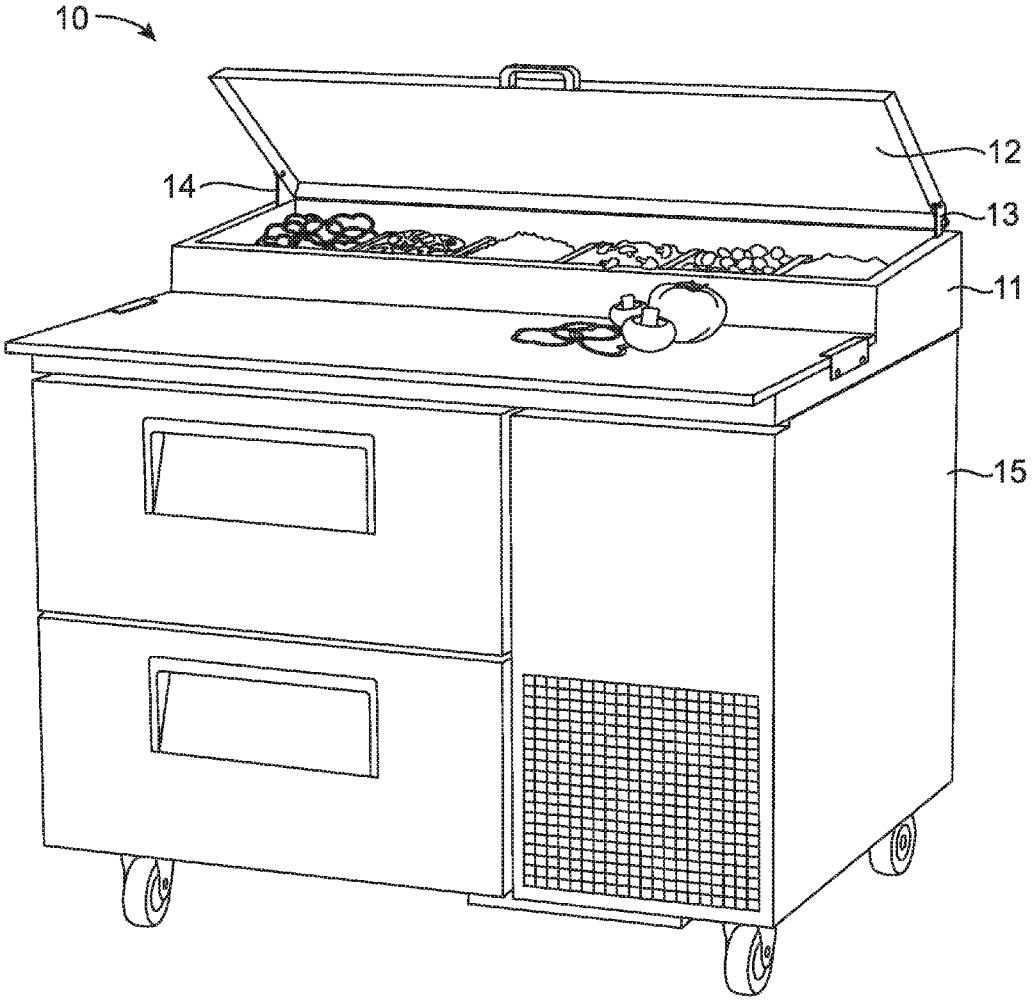
FIG. 1 is an isometric view of an example of a refrigerated food preparation table having a food item storage pan and a lid shown in a partially open position.

The drawings provided herewith illustrate, among other things, examples of certain aspects of particular embodiments. Other embodiments, however, may differ. Various embodiments may include aspects shown in the drawings, known in the art, or a combination thereof, as examples. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

DETAILED DESCRIPTION OF EXAMPLES OF EMBODIMENTS

This patent application describes, among other things, examples of certain embodiments, and certain aspects thereof. Other embodiments may differ from the particular examples described in detail herein. Various embodiments are or concern appliances, such as (e.g., refrigerated) food preparation tables, for instance, that include a food item storage pan that has a lid. Further, in a number of embodiments, the lid is allowed to fully close over the food item storage pan and the lid is held in a partially open position and in a fully open position (e.g., by one or more of multiple hinges). Further, various embodiments are or concern apparatuses for holding a lid in a partially opened position and a fully opened position. In a number of embodiments, such an apparatus includes a slot, a surface, an indentation, or a combination thereof, for instance, that act on pins on the lid. In various embodiments, the slot receives one such pin, the surface guides another pin on the lid, for instance, as the lid is opened from the fully closed position to the partially opened position, the indentation receives the second pin when the lid is in the partially opened position, the slot contains the first pin and the second pin when the lid is in the fully opened position, or a combination thereof.

FIG. 1 illustrates refrigerated food preparation table 10 that includes food item storage pan 11 that includes lid 12 and multiple (i.e., two shown) hinges 13 and 14 connecting (i.e., pivotably connecting) lid 12 to remainder 15 of the refrigerated food preparation table 10. In the embodiment depicted, remainder 15 includes all of refrigerated food preparation table 10 except for lid 12 and multiple hinges 13 and 14. In the embodiment shown, the multiple hinges 13 and 14 allow lid 12 to fully close over food item storage pan 11 and the hinges (i.e., one or both of hinges 13 and 14) hold lid 12 in a partially open position (as shown), and the hinges (i.e., one or both of hinges 13 and 14) hold lid 12 in a fully open position (e.g., vertical). In the embodiment shown, lid 12 is moved manually by a chef, cook, or a food preparation technician, as examples.

In some embodiments, refrigerated food preparation table 10 is a pizza preparation table, for example, and food item storage pan 11 stores pizza toppings such as cheese, pepperoni, sausage, ham, bell peppers, onions, black olives, pinapple, and the like for preparing pizzas. In some embodiments, lid 12 is closed to preserve the food items between orders of the food products (e.g., pizza), is positioned in the partially opened position when making the food products (e.g., pizza) and is positioned in the fully opened position (e.g., vertical) when restocking the food items (e.g., pizza toppings) in food item storage pan 11. In a number of embodiments, in the partially open positon, lid 12 protects the food items better than when lid 12 is in the fully open position.

In various embodiments, a refrigerated food preparation table (e.g., 10) further includes one or more (e.g., refrigerated) drawers, cupboards, or both, for instance, for storing food (e.g., pizza dough, pizza toppings, pizza sauce, or a combination thereof). In a number of embodiments, the table (e.g., 10) is mounted on wheels (e.g., casters). Further, in various embodiments, a refrigerated food preparation table (e.g., 10) further includes a (e.g., forced air, capillary tube, 240 V) refrigeration system or unit, for instance, for cooling the food items. Further, in a number of embodiments, a refrigerated food preparation table (e.g., 10) further includes a table area that can include, in various embodiments, a cutting board. In some embodiments (e.g., as shown), the cutting board covers the table area (i.e., not including food item storage pan 11). Further, in some embodiments, the cutting board, food item storage pan (e.g., 11), lid (e.g., 12), or a combination thereof, are removable for washing. In some embodiments, the table (e.g., 10) is metal, such as stainless steel, aluminum, or both. Isem the table cutting board, or both, are plastic. For example, in some embodiments, the cutting board is polyethylene (e.g., white). Still further, in some embodiments, the refrigerated areas of the table are insulated (e.g., with polyurethane insulation).

Figure 2:
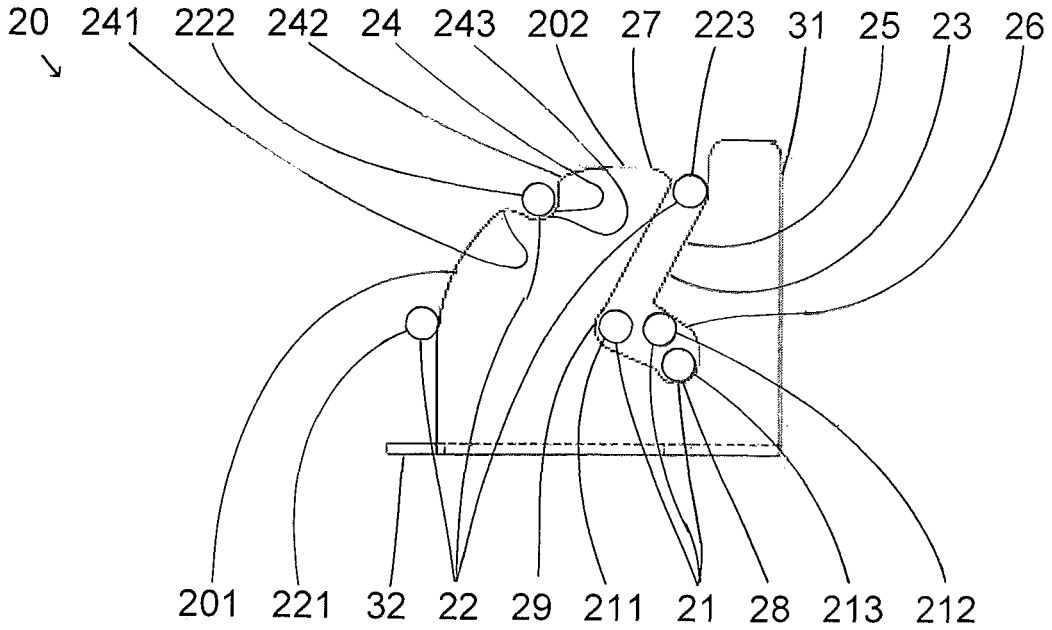
FIG. 2 is a side view of an apparatus for holding a lid (e.g., of the food preparation table shown in FIG. 1) in a partially opened position and a fully opened position, showing, among other things, locations of pins on the lid when the lid is in different positions.

FIG. 2 illustrates hinge, hinge bracket, or apparatus 20 for holding a lid (e.g., 12 shown in FIG. 1) in a partially opened position (e.g., as shown in FIG. 1) and a fully opened position (e.g., vertical). Apparatus 20 is an example of an apparatus for holding a lid (e.g., 12) in a partially opened position and a fully opened position. In the embodiment depicted, the lid (e.g., 12) or hinge (e.g., 13 or 14) includes first pin 21 and second pin 22 each shown in three alternate locations in FIG. 2. In the embodiment shown, apparatus 20 (e.g., at least one of multiple hinges or a hinge bracket) includes slot 23, first surface 201, and indentation 24, that together act on first pin 21 and second pin 22 in this embodiment. In the embodiment shown, slot 23 receives first pin 21, and first (e.g., curved, for example, convex) surface 201 guides second pin 22 as the lid (e.g., 12) is opened from the fully closed position to the partially opened position. As used herein, a surface is "curved" if at least part of the surface is curved and the total curvature of the surface exceeds a 10 degree angle.

Apparatus 20 is an example of one of, or part of one of, hinges 13 and 14 shown in FIG. 1. In certain embodiments, each of hinges 13 and 14 of refrigerated food preparation table 10 includes one of apparatus 20 and first pin 21 and second pin 22. In other embodiments, however, one of hinges 13 and 14 of refrigerated food preparation table 10 includes one apparatus 20 and first pin 21 and second pin 22 and the other of hinges 13 and 14 is a different type of hinge, for example, a conventional hinge, for instance, with a single pin. Still other embodiments have one or more intermediate hinges, and in some embodiments, such intermediate hinge(s) include an apparatus 20. Further, some embodiments (e.g., of food preparation tables) include multiple lids and, in particular embodiments, more than one of the multiple lids include one, two, or more of apparatus 20, for example. Even further, in the embodiment illustrated, apparatus 20 allows lid 12 to be removed, for example, for cleaning. Moreover, as used herein, a hinge "connecting" a lid (e.g., to a remainder of a table), does not preclude that the lid can be lifted off, for example, by sliding first pin 21 out of slot 23.

Referring to FIG. 2, in the embodiment shown, first pin 21 and second pin 22 are in locations 211 and 221 (respectively) when the lid (e.g., 12) is in the fully closed position, first pin 21 and second pin 22 are in locations 212 and 222 (respectively) when the lid (e.g., 12) is in the partially open position (e.g., as shown in FIG. 1), and first pin 21 and second pin 22 are in locations 213 and 223 (respectively) when the lid (e.g., 12) is in the fully open position. Thus, in the embodiment illustrated, indentation 24 receives second pin 22 when the lid (e.g., 12) is in the partially opened position. Further, in this particular embodiment, slot 23 contains first pin 21 and second pin 22 when the lid (e.g., 12) is in the fully opened position (e.g., vertical). Further still, in this particular embodiment, slot 23 contains first pin 21 when the lid (e.g., 12) is in any of the fully closed position, the partially open position (e.g., as shown in FIG. 1), and the fully opened position (e.g., vertical). Even further, in the embodiment depicted, first pin 21 is parallel to second pin 22. As used herein, "parallel" means parallel to within 10 degrees, unless indicated otherwise. In different embodiments, however pins 21 and 22 are parallel to within 5, 15, 20, 25, or 30 degrees, as other examples. In the embodiment depicted, first pin 21 and second pin 22 are right circular cylinders, for example, and their centerlines are parallel (i.e., to within 10 degrees).

Figure 3:
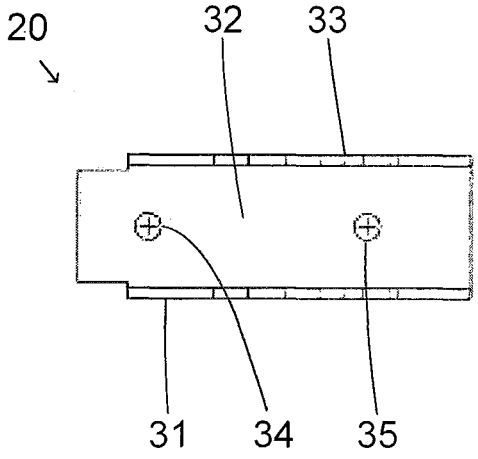
FIG. 3 is a top view of the apparatus for holding a lid of FIG. 2.

In the embodiment illustrated, hinge, hinge bracket, or apparatus 20 includes first (e.g., flat) plate 31, shown in FIGS. 2 and 3, for example, that includes (e.g., as shown in FIG. 2) slot 23, first (e.g., curved or convex) surface 201, and (e.g., concave) indentation 24. Further, in the embodiment illustrated, slot 23, first (e.g., convex) surface 201, and (e.g., concave) indentation 24 are formed or cut into first (e.g., flat) plate 31. Further still, apparatus 20 includes, in the embodiment shown, second (e.g., flat) plate 32, which is shown, perpendicular to first (e.g., flat) plate 31. In the embodiment shown, second plate 32 is connected to first plate 31, for instance, via a bend or weld. As used herein, a plate is considered to be flat if the plate is flat to within the thickness of the plate. In some embodiments, one or more of the plates described herein is flat according to this criteria. In other embodiments, a plate described herein is flat to within 1/10, 1/4, 1/2, 3/4, 1.5 times, 2 times, or 3 times the thickness of the plate, as other examples. Further, as used herein, two plates are considered to be "connected" if the plates are integral but are separated by bend of more than 25 degrees. In other embodiments, plates can be connected (i.e., as used herein) in anther way, for example, with a weld. Still further, as used herein, "perpendicular", unless indicated otherwise, means to within 10 degrees. Even further, where two plates are described herein as being perpendicular (i.e., to within 10 degrees), in other embodiments, such plates are perpendicular to within 5, 15, 20, 25, 30, 40, 45, or 50 degrees, as other examples.

In some embodiments, the second (e.g., flat) plate (e.g., 32) attaches (e.g., one of the multiple hinges, for instance, apparatus 20) to the remainder (e.g., 15 shown in FIG. 1) of the refrigerated food preparation table (e.g., 10). Moreover, in the embodiment shown, second (e.g., flat) plate 32 is for attaching apparatus 20 to a mounting surface that supports the lid (e.g., 12). The top of pan 11 shown in FIG. 1 is an example of such a mounting surface. Further, the top of remainder 15 of table 10 shown in FIG. 1 is another example of such a mounting surface. Further, in the embodiment illustrated, plate 32 includes multiple holes (e.g., two holes) 34 and 35 shown in FIG. 3 for attaching apparatus 20 to the mounting surface, for instance, top of pan 11, or remainder 15, of table 10, that supports the lid (e.g., 12), for example, with fasteners such as screws, rivets, or bolts, as examples.

Further, in the embodiment illustrated, hinge bracket or apparatus 20 further includes third (e.g., flat) plate 33, shown in FIG. 3, that is, in this particular embodiment, essentially the same as plate 31, and first and second pins 21 and 22 extend through plates 33 and 31. In some embodiments, plate 33 includes, among other things described herein, duplicates of slot 23, first surface 201, and indentation 24, for example. In the embodiment shown, plates 31, 32, and 33 are formed by cutting and bending one piece of flat sheet metal into the three plates of apparatus 20. Other embodiments differ. In some embodiments, for example, plate 33 is omitted, plate 31 is attached to plate 32 by welding, or both.

Still further, the embodiment of apparatus 20 shown in FIG. 2 includes second (e.g., curved, for example, convex) surface 202 on first plate 31. In this particular embodiment, second surface 202 guides second pin 22 as the lid (e.g., 12) is opened from the partially open position (e.g., shown for lid 12 in FIG. 1) to the fully opened position (e.g., where pins 21 and 22 are at locations 213 and 223 respectively shown in FIG. 2). Even further, in the embodiment depicted, second surface 202 is between indentation 24 and slot 23. Further still, in other embodiments, first (e.g., curved) surface 201, second (e.g., curved) surface 202, or both, are concave, as other examples. Moreover, in still other embodiments, where first surface 201, second surface 202, or both, are shown herein, in other embodiments, a straight or flat surface is provided, as still other examples.

Further still, in the embodiment illustrated, slot 23 includes top portion 25 and bottom portion 26. As shown, top portion 25 slopes in a substantially opposite direction from bottom portion 26. As used herein, two features slope in substantially opposite directions if one feature slopes to the left from vertical and the other features slopes to the right from vertical. Even further, as used herein, indications of direction such as "vertical", "top", and "bottom", refer to directions when the product is in use. In a number of embodiments, the direction of gravity (e.g., acting on lid 12) is relevant to the functioning of the apparatus or table when in use. Moreover, in the embodiment illustrated, top portion 25 slopes in the opposite direction from bottom portion 26. As used herein, two features slope the opposite direction (without opposite being preceded by "substantially") if one feature slopes to the left from vertical and the other features slopes to the right from vertical and an angle between the slopes of the two features is between 45 and 135 degrees.

Even further, in the embodiment shown, top portion 25 is at a substantially right angle 29 to bottom portion 26. As used herein, "substantially", when referring to right angles, means to within 15 degrees of a perfect right angle, and is measured from whichever side (e.g., left side or right side as shown) of the portion (e.g., 25 or 26) is closer to a right angle. Even further still, in the embodiment shown, top portion 25 is at a right angle 29 to bottom portion 26. As used herein, "right angle", when not preceded by the word "substantially", means to within 10 degrees of a perfect right angle, and is measured from whichever side of the portion (e.g., 25 or 26) is closer to a right angle. In other words, in the embodiment shown, angle 29 is both a substantially right angle and a right angle. Other embodiments, however, may differ.

Moreover, in the embodiment depicted, (e.g., substantially) right angle 29 is substantially midway between top 27 and bottom 28 of slot 23. As used herein "substantially midway between" two locations means between ⅓ and ⅔s of the distance between the two locations from either location. In some embodiments, an (e.g., substantially) right angle is "midway between" a top and a bottom of a slot, such as slot 23. As used herein "midway between" two locations, without being preceded by "substantially" means between 40 percent and 60 percent of the distance between the two locations from either location. Furthermore, in the embodiment shown, indentation 24, shown in FIG. 2, includes first convex surface 241, second convex surface 242, and concave surface 243. In the embodiment illustrated, concave surface 243 is between first convex surface 241 and second convex surface 242. Various surfaces described herein, (e.g., 201, 201, 241, 242, and 243) re formed into an edge of first (e.g., flat) plate 31, in the embodiment shown. Other embodiments, however. may differ.

What is claimed is:

1. A refrigerated food preparation table comprising a food item storage pan comprising a lid and multiple hinges connecting the lid to a remainder of the refrigerated food preparation table, the lid comprising a first pin and a second pin, the multiple hinges comprising:

a slot receiving the first pin;

a first surface that guides the second pin as the lid is opened from the fully closed position to the partially opened position; and an indentation receiving the second pin when the lid is in the partially opened position;

wherein the slot contains the first pin and the second pin when the lid is in the fully opened position; and wherein: the multiple hinges allow the lid to fully close over the food item storage pan; the hinges hold the lid in a partially open position; and the hinges hold the lid in a fully open position.

2. The refrigerated food preparation table of claim 1 comprising a first flat plate comprising the slot, the first surface, and the indentation.

3. The refrigerated food preparation table of claim 2 further comprising a second flat plate perpendicular to the first flat plate, wherein the second flat plate attaches to the remainder of the refrigerated food preparation table.

4. The refrigerated food preparation table of claim 1 further comprising a second surface that guides the second pin as the lid is opened from the partially open position to the fully opened position.

5. The refrigerated food preparation table of claim 4 wherein the second surface is between the indentation and the slot.

6. The refrigerated food preparation table of claim 1 wherein the slot comprises a top portion and a bottom portion, wherein the top portion slopes in a substantially opposite direction from the bottom portion.

7. The refrigerated food preparation table of claim 6 wherein the top portion is at a right angle to the bottom portion.

8. The refrigerated food preparation table of claim 1 wherein the indentation comprises a first convex surface, a second convex surface, and a concave surface between the first convex surface and the second convex surface.

9. The refrigerated food preparation table of claim 1 comprising:

a first plate comprising the slot, the first surface, the indentation, and a second surface that guides the second pin on the lid as the lid is opened from the partially open position to the fully opened position, wherein:

the first pin is parallel to the second pin;

the second surface is between the indentation and the slot;

the slot comprises a top portion and a bottom portion;

the top portion slopes in a substantially opposite direction from the bottom portion;

the top portion is at a substantially right angle to the bottom portion; and the substantially right angle is substantially midway between a top and a bottom of the slot; and a second plate substantially perpendicular to the first plate and connected to the first plate, that attaches one of the multiple hinges to the remainder of the refrigerated food preparation table.

10. An apparatus holding a lid in a partially opened position and a fully opened position, the lid having first and second pins, the apparatus-comprising:

a slot for receiving the first pin of the lid;

a first surface that guides the second pin of the lid as the lid is opened from a fully closed position to a partially opened position; and an indentation that receives the second pin when the lid is in the partially opened position;

wherein the slot contains the first pin and the second pin when the lid is in the fully opened position.

11. The apparatus of claim 10 comprising a first flat plate comprising the slot, the first surface, and the indentation.

12. The apparatus of claim 11 further comprising a second flat plate perpendicular to the first flat plate, wherein the second flat plate comprises multiple holes for attaching the apparatus to a mounting surface that supports the lid.

13. The apparatus of claim 10 further comprising a second surface that guides the second pin on the lid as the lid is opened from the partially open position to the fully opened position.

14. The apparatus of claim 13 wherein the first surface is curved, the second surface is curved, and the second surface is between the indentation and the slot.

15. The apparatus of claim 10 wherein the slot comprises a top, a bottom, and a right angle, wherein the right angle is substantially midway between the top and the bottom.

16. The apparatus of claim 10 wherein the slot comprises a top portion and a bottom portion, wherein the top portion slopes in a substantially opposite direction from the bottom portion.

17. The apparatus of claim 16 wherein the top portion is at a right angle to the bottom portion.

18. The apparatus of claim 10 wherein the indentation comprises a first convex surface, a second convex surface, and a concave surface between the first convex surface and the second convex surface.

19. The apparatus of claim 10 comprising:

a first plate comprising the slot, the first surface, the indentation, and a second surface that guides the second pin on the lid as the lid is opened from the partially open position to the fully opened position, wherein:

the second surface is between the indentation and the slot;

the slot comprises a top portion and a bottom portion;

the top portion slopes in a substantially opposite direction from the bottom portion;

the top portion is at a substantially right angle to the bottom portion; and the substantially right angle is substantially midway between a top and a bottom of the slot;

the indentation comprises a first convex surface, a second convex surface, and a concave surface between the first convex surface and the second convex surface; and a second plate substantially perpendicular to the first plate and connected to the first plate, for attaching the apparatus to a mounting surface that supports the lid.

* * * * *